US005495678A

United States Patent [19]

Ilmarinen et al.

[11] Patent Number: 5,495,678

[45] Date of Patent: Mar. 5, 1996

[54] DRYING MODULE AND DRYER SECTIONS THAT MAKE USE OF SAME, IN PARTICULAR FOR A HIGH-SPEED PAPER MACHINE

[75] Inventors: Antti Ilmarinen; Heikki Ilvespää; Antti Kuhasalo, all of Jyväskylä; Jouko Yli-Kauppila, Muurame; Pertti Heikkilä, Raisio; Iikka Jokioinen, Lieto; Matti Korpela, Turku; Henrik Petterson, Mynämäki; Mikko Karvinen, Vihtavuori; Väinö Sailas, Vaajakoski; Pekka Taskinen, Jyväskylä, all of Finland; Dick Parker, Cape Elizabeth, Me.

[73] Assignee: Valmet Paper Machinery, Inc., Helsinki, Finland

[21] Appl. No.: 201,555

[22] Filed: Feb. 24, 1994

[30] Foreign Application Priority Data

Mar. 22, 1993 [FI] Finland ..... 931263

[51] Int. Cl.$^6$ ..... F26B 11/02

[52] U.S. Cl. ..... 34/117; 34/115; 34/116

[58] Field of Search ..... 34/115, 116, 117

[56] References Cited

U.S. PATENT DOCUMENTS

| | | | |
|---|---|---|---|
| 3,301,746 | 4/1964 | Sanford et al. | 162/113 |
| 3,418,723 | 12/1968 | Burgess et al. | 34/1 |
| 3,447,247 | 6/1969 | Daane | 34/122 |
| 3,541,697 | 8/1970 | Villalobos | 34/115 |
| 3,816,941 | 6/1974 | Holik et al. | 34/116 |
| 3,868,780 | 3/1975 | Soininen et al. | 34/116 |
| 3,956,832 | 5/1976 | Justus | 34/115 |
| 4,033,048 | 7/1977 | Van Ike | 34/92 |
| 4,033,049 | 7/1977 | Schiel et al. | 34/115 |
| 4,064,637 | 12/1977 | Lindgren | 34/122 |
| 4,972,608 | 11/1990 | Ilvespaa | 34/115 |
| 5,022,163 | 6/1991 | Ilvespaa et al. | 34/23 |
| 5,383,288 | 1/1995 | Ilmarinen | 34/392 |

FOREIGN PATENT DOCUMENTS 0559628 9/1993 European Pat. Off. .

*Primary Examiner*—Henry A. Bennett
*Assistant Examiner*—Siddharth Ohri
*Attorney, Agent, or Firm*—Steinberg, Raskin & Davidson

[57] ABSTRACT

A method and device for drying a paper web wherein the paper web is supported on a drying wire without long open draws of the web. The paper web is contact-dried by pressing it with the drying wire onto a face of a contact-drying cylinder whose diameter is greater than about 1.5 m on a sector b whose magnitude is greater than about 180°. The web is evaporation-dried as blowing-on drying and/or as through-drying by means of high-velocity drying-gas jets applied to the web on the drying wire on the face of the following large-diameter cylinder whose diameter is greater than about 2 m on a sector a having a magnitude greater than about 180° while the web is on the side of the outside curve. The web to be dried is passed over a sector c of the suction roll which is subjected to negative pressure while the web is supported on the drying wire at the side of the outside curve. The magnitude of the sector of the suction roll has a magnitude greater than about 160° and the diameter of the suction roll is less than the diameter of the contact-drying cylinder.

30 Claims, 7 Drawing Sheets

FIG. 9
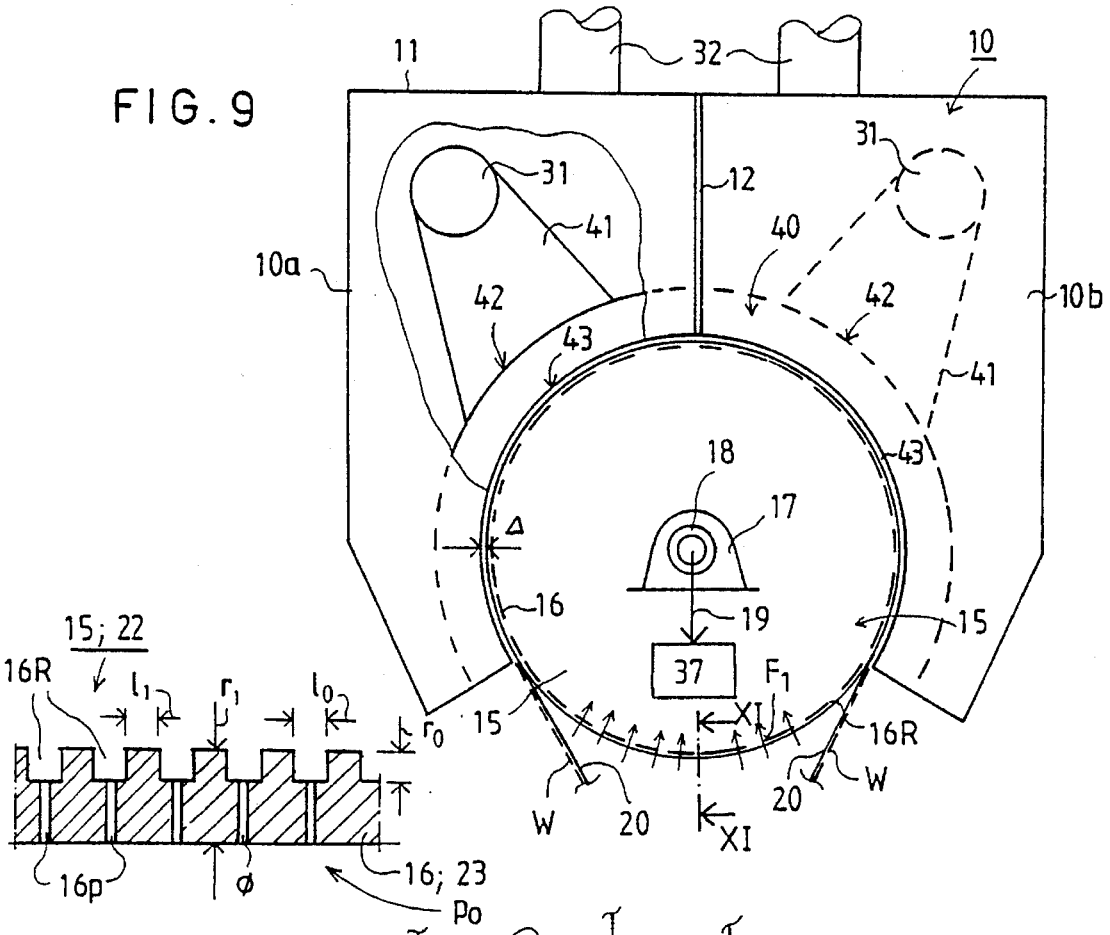
FIG. 11
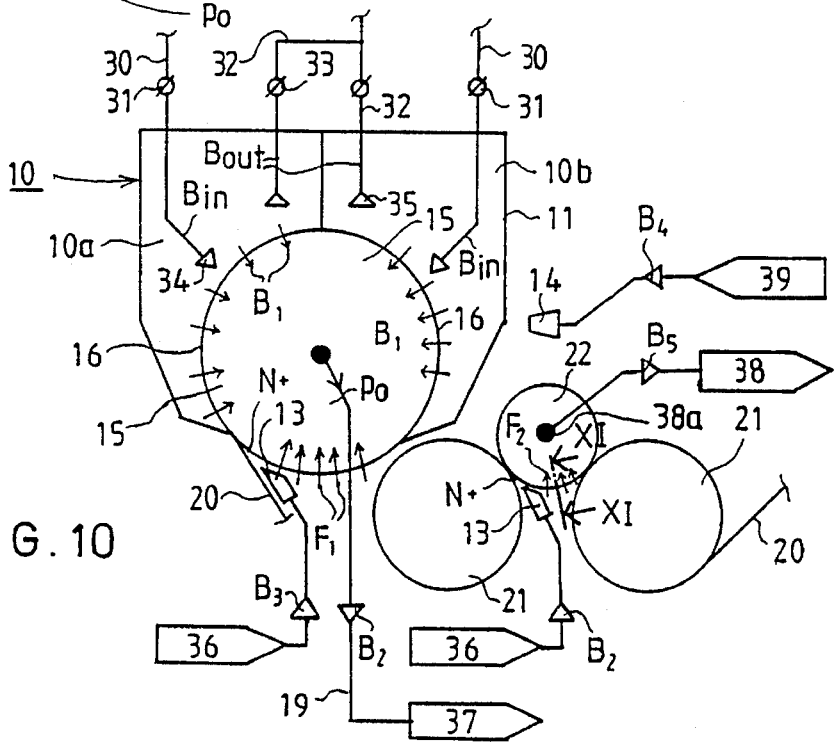
FIG. 10

DRYING MODULE AND DRYER SECTIONS THAT MAKE USE OF SAME, IN PARTICULAR FOR A HIGH-SPEED PAPER MACHINE

BACKGROUND OF THE INVENTION

The present invention relates to a method for drying a paper web in which the paper web is supported by a drying wire without substantially long open draws of the web over the length of the portion of the web that is being dried.

The invention also relates to a drying module for the dryer section of a paper machine, which is intended in particular for use in dryer sections of high-speed paper machines wherein the web running speed is from about 25 meters per second to about 40 meters per second. The drying modules include a drying-wire loop guided by guide rolls, drying cylinders, and at least one reversing suction roll.

The invention further relates to a dryer section which includes the drying modules mentioned above.

The invention also relates to various hybrid dryers including the above drying modules and prior art groups of drying cylinders.

The highest web speeds in paper machines are currently already in a range of about 25 meters per second. In the near future, a web speed range above 25 m/s to about 40 m/s will be used. At these speeds, a bottle-neck in the runnability of a paper machine will be the dryer section whose length with the use of the prior art multi-cylinder dryers would also be intolerably long. For example, if it is considered that an existing multi-cylinder dryer were operated at a web speed of about 40 m/s, it would comprise about 70 drying cylinders, and its length in the machine would be about 180 m. In such a case, the dryer would comprise about 20 different wire groups and a corresponding number of group-gap draws. It can be assumed that, in a speed range of from about 30 m/s to about 40 m/s, the runnability of normal prior art multicylinder dryers would not be even nearly satisfactory, but there would be a great number of web breaks, which lowers the efficiency of the paper machine.

In the speed range of from about 30 m/s to about 40 m/s and at higher web running speeds, the prior art multi-cylinder dryers would become uneconomical to operate because the investment cost of an excessively long paper machine hall would become unduly high. It can be estimated that the cost of a paper machine hall is currently typically about 1 million FIM per meter (about $175,000 per meter) in the machine direction.

In a paper machine hall, space is usually available in the direction of height (usually the z-direction), and so it has been suggested that the cylinders in a multi-cylinder dryer be arranged in vertical stacks. However, in such an arrangement, especially when used in paper machines having high web running speeds, the problems of runnability and broke removal are emphasized and are likely to be very difficult to solve in the speed range of from about 30 m/s to about 40 m/s. With respect to the prior art showing such a vertical arrangement, reference is made to the assignee's Finnish Patent Application No. 890786 (corresponding to U.S. Pat. No. 4,972,608, the specification of which is incorporated by reference herein).

One parameter that illustrates the drying capacity of prior art multi-cylinder dryers is the amount of water evaporated in the dryer section per unit of length and width, i.e., per floor area covered by the web to be dried, in a unit of time.

In the prior art multi-cylinder dryers, this parameter is typically in a range of from about 50 kilograms of $H_2O$ per square meter in an hour to about 80 kilograms of $H_2O$ per square meter in an hour (kg $H_2O/m^2/h$).

It is known in the prior art to use various blowing-on/blowing-through units for evaporation drying of the paper web. These units have been used in particular for drying tissue paper. With respect to the prior art showing such units, reference is made by way of example to the following patents: U.S. Pat. Nos. 3,301,746, 3,418,723, 3,447,247, 3,541,697, 3,956,832, 4,033,048, Finnish Patent No. FI 57,457 (corresponding to U.S. Pat. No. 4,064,637 and Swedish Patent No. SE 7503134-4), and Finnish Patent No. FI 87,669 (corresponding to Finnish Patent Application No. 920942 and U.S. patent application Ser. No. 08/025,191 filed Mar. 2, 1993, the specification of which is incorporated by reference herein).

One notable patent among the patents listed above is U.S. Pat. No. 4,033,048 (assigned to J. M. Voith) which describes a paper web dryer. However, the dryer described in this patent is not suitable for use in paper machines where the speeds of the web is high, e.g., greater than about 25 m/s, and to which the present invention is directed. Therefore, the paper machine described in this reference is clearly not suitable for specific web running speeds in a range from about 30 m/s to about 40 m/s or even higher.

In this respect and in other respects, the device described in the '048 patent has several drawbacks as follows. Briefly, in the device of the '048 patent, a suction box is arranged inside a support-fabric loop. By means of the suction box, both a large suction roll and a pocket placed underneath the suction roll and between outside heated rolls are subjected to negative pressure. However, a problem arises in connection with the lateral seals through which significant amounts of air leak. The leakage air produces a strong air current in the transverse direction of the machine in the lateral areas of the web. This air current deteriorates the stable run of the web through the dryer and, consequently, the runnability and the efficiency of the whole machine. Owing to the large amount of leakage air, the subjecting of the pocket and the roll to the level of negative pressure that is necessary at high speeds in order to ensure a stable run of the web, requires large air ducts and blowers and, therefore, consumes a lot of energy. This is a significant drawback which curtails the effectiveness and use of the device of the '048 patent at high web running speeds.

OBJECTS AND SUMMARY OF THE INVENTION

Accordingly, it is an object of the present invention to provide novel solutions for the problems discussed above.

It is another object of the present invention to provide a new and improved method for evaporation drying of a paper web, a new and improved drying module, and a new and improved dryer section that makes use of the drying module, which are suitable for use in a paper machine running at high web speeds greater than about 25 m/s. The web running speeds are most appropriately in a range from about 30 m/s to about 40 m/s or even higher. It is understood though that the present invention could also be used at lower web running speeds but a significant advantage is achieved when the present invention is operated at these higher web running speeds.

It is yet another object of the present invention to provide novel solutions of drying for the speed range mentioned above so that, in spite of the relatively high web speed, the runnability of the dryer section can be kept at a satisfactory level.

It is still another object of the present invention to provide a new and improved hybrid dryer in which both contact drying on a drying cylinder and blowing-on drying are applied in a novel synergic way.

It is a further object of the present invention to increase the drying speed of a dryer section and thereby to make the dryer section shorter by means of a blowing-on flow and/or blowing-through flow. This arrangement contributes to an improved runnability of the dryer.

It is another object of the present invention to provide a new and improved method and device for drying a paper web by whose means the length of the dryer section in the machine direction becomes reasonable when the machine operates at a high speed. Thus, the length of the dryer section at least does not become substantially longer than the length of the prior art multicylinder dryers. In this regard, renewals and modernizations of paper machines in existing paper machine halls to bring the web running speeds of these machines up to a web speed of about 40 m/s and even higher can be effected.

It is a further object of the invention to provide a drying method, and a dryer section that makes use of the method, in which the web is reliably fixed to the drying wire over the entire length of the dryer section so that transverse shrinkage of the web is substantially prevented, whereby transverse non-homogeneity of the web, arising from an uneven transverse shrinkage profile, is substantially avoided.

In view of achieving the objects stated above and others, the method of the present invention comprises a combination of the following steps (a), (b), (c), and (d):

(a) the paper web is contact-dried by pressing it with the drying wire on a face of a cylinder whose diameter $D_2$ is preferably greater than about 1.5 m, on a sector b whose magnitude b is preferably greater than about 180° (a contact-drying step);

(b) evaporation drying is carried out as blowing-on drying and/or as through-drying by means of high-velocity drying-gas jets applied to the web on the drying wire on the face of the a large-diameter cylinder (the diameter $D_1$ of the large-diameter cylinder preferably being greater than about 2 m) on a sector a which is preferably greater than about 180° while the web is on the side of the outside curve (an evaporation-drying step);

(c) a step (a) substantially the same as that defined above is carried out;

(d) before the step (a) and/or after the step (c), the web to be dried is passed over a sector c of the suction roll (a suction-drying step). Sector c is subjected to negative pressure while the web is supported on the drying wire at the side of the outside curve. The magnitude of sector c is preferably greater than about 160° and the diameter $D_3$ of the suction roll is preferably greater than $D_2$ (the diameter of the contact-drying cylinder).

The drying module in accordance with the invention includes a large-diameter ($D_1$) blowing-on and/or through-drying cylinder whose diameter is greater than about 2 m and which is placed inside the drying-wire loop. In proximity to the blowing-on/through-drying cylinder, at both sides thereof, a smooth-faced heated contact-drying cylinder is placed at each respective side. The smooth-faced heated contact-drying cylinders have a diameter $D_2$ which is greater than $D_1$ and are placed outside the same drying-wire loop. In the running direction of the web, before and/or after the contact-drying cylinder, inside the same drying-wire loop, at least one reversing suction roll is placed. The reversing suction roll has a diameter $D_3$ which is greater than $D_2$. The drying cylinders and reversing suction rolls are placed in relation to one another so that contact sectors of the web and of the drying wire on the drying cylinders and suction rolls are: a greater than about 180° and b greater than about 180°, respectively. The outer mantle of the blowing-on and/or through-drying cylinder is provided with grooves and/or is penetrable by drying gas. Further, a drying hood is arranged on the contact sector a of the mantle. In the interior of the hood, in proximity to the outer face of the web to be dried, there is a nozzle field through which a set of drying-gas jets can be applied at a high velocity ($V_9$) against a free outer face of the web to be dried over a substantial area of sector a.

The scope of the present invention also includes hybrid dryer sections in which drying modules in accordance with the present invention are employed at suitable locations together with prior art cylinder groups, in particular together with so-called "normal" cylinder groups having a single-wire draw. In such "normal" groups, the drying cylinders are placed in an upper row and the reversing suction rolls are placed in a lower row, or vice versa. Between the normal groups and the drying modules in accordance with the invention, preferably closed group-gap draws are employed.

In the present invention, the prior art blowing-on and/or through-drying and the contact drying by means of heated contact-drying cylinders have been combined in a novel manner. In order that the objects of the present invention could be achieved at the high web speeds (v greater than about 25 m/s) concerned, in particular in the speed range of about 30 m/s to about 40 m/s, the drying steps and the geometry of the drying modules must be arranged in the specific manner as set forth in accordance with the invention. Moreover, in the present invention, consideration has been given to a factor which is decisive in view of the runnability of the dryer section. This factor is that, when the web is placed on support of a wire on the blowing-on and/or through-drying cylinders and on reversing suction rolls, at the side of the outside curve, it tends to separate from the drying wire by the effect of centrifugal forces while the separating force is proportional to the factor $v_2/r$, wherein r is the radius of cylinder or roll. In order to prevent this separation, in the present invention, preferably at the blowing-on and/or through-drying cylinders and reversing suction rolls, a difference in pressure is provided, which is dimensioned high enough so that separation of the web is prevented in substantially all cases, and the runnability of the web is maintained even in this respect. The difference in pressure can also be used to promote the through-drying especially at the blowing-on and/or through-drying cylinders.

In the present invention, either air or superheated steam is used as the drying gas (other well-known drying gases could also be used). The state of the drying gas is chosen at each drying stage in consideration of the manner in which the water is bound to the fiber mesh of the paper web at each particular drying stage. In this way, a drying process is provided that is optimal both in view of the paper quality and in view of the drying.

In a drying module in accordance with the invention, as a blowing-on and/or through-drying cylinder and as a reversing suction roll, most advantageously, such drying cylinders and reversing suction rolls provided with grooved and perforated mantles can be used, e.g., those marketed by the assignee under the trade mark VAC™ roll described in the assignee's Finnish Patent No. FI 83,680 (corresponding to U.S. Pat. No. 5,022,163, the specification of which is hereby incorporated by reference herein). As a through-drying cylinder, it is possible to use a blow-through roll that has a higher negative pressure and a larger open area. One roll of this type is, e.g., the product marketed by the assignee under the trade mark HONEYCOMB™.

In the present invention, as the web is kept firmly in contact with the drying wire over the entire length of the dryer section, a difference in pressure can, if necessary, be employed on the curved sectors on which the web remains outside. This application of a pressure differential functions to prevent transverse shrinkage of the web during drying and eliminate transverse non-homogeneity of the web arising from an uneven transverse shrinkage profile.

In the present invention, it is also possible to use a pressurized hood, and/or, as the large cylinder concerned, a cylinder provided with a grooved mantle or a corresponding wire-sock mantle as the hood of the blowing-on and/or through-drying cylinder. In this case, the difference in pressure, by whose means the web is kept on support of the drying wire, can be produced primarily by means of the pressurization of the hood. Also, by pressurizing the hood, the flowing of the drying gases through the web is also achieved, when necessary.

In a drying module in accordance with the invention or in a number of successive modules, the hood of the blowing-on and/or through-drying cylinder can be divided into a number of blocks in the transverse direction of the machine by means of walls placed in the machine direction. Drying gases of different temperature, humidity and/or pressure are passed into the blocks, or sets of drying-gas jets of different velocities are employed in the blocks. In this manner, the drying of the paper web can be regulated in the transverse direction, and a favorable moisture profile can be obtained, e.g., having a certain desired form, usually uniform, in the transverse direction.

The pocket placed underneath the "large cylinder", which is employed in a dryer in accordance with the present invention, is not intended to be subjected to negative pressure by means of a suction device placed inside the fabric loop (as in the case of the device described in U.S. Pat. No. 4,033,048). The large cylinder, and also the smaller reversing suction rolls placed between the drying cylinders, such as the assignee's VAC™ rolls, are individually provided with a suction duct placed in the shaft of the roll. This arrangement differs from the arrangement described in the '048 patent wherein there is only one outer roll which can be heated between the large suction rolls, i.e. "center rolls", that employ the same support fabric.

In a preferred embodiment of the dryer in accordance with the present invention, a grouping of at least two contact-drying cylinders and a reversing suction roll of smaller diameter placed between them is arranged between two blowing-on cylinders (large cylinders) placed inside the same support-fabric loop. This particular arrangement emanates from the practical limitations of constructing a blowing-on hood having a maximally large covering area around a roll at the same time as it is desirable to obtain a maximally efficient support for the web between the blowing-on rolls.

Another difference between the present invention and the '048 patent is that in the arrangement described in the '048 patent, only a hot-air hood is mentioned. However, in the present invention, it is expressly essential that, if hot air is used as the medium, the air has a considerable velocity against the web in the blowing-on drying. Owing to the difficulties mentioned above, the device suggested in the '048 patent is not suitable for through-drying. Moreover, the possibility of conducting through-drying, or blowing-on drying, of the web has not been mentioned in the '048 U.S. patent. In the '048 patent, the web-heating effect of the outer rolls remains very small because of the small covering angle. By means of the present invention, a dryer geometry is accomplished in which the heated contact cylinders can also be utilized efficiently for evaporation from the web.

In a preferred embodiment of the present invention, in the first drying module or modules, large cylinders and contact-drying cylinders which have larger diameters than those employed in the rear drying module or modules are used. In the latter or rear drying modules, it is preferable to employ such diameters of large cylinders and contact-drying cylinders as well as of reversing cylinders which have been chosen to be optimal in view of the quality of the paper to be produced and in view of the machine construction. By regulating the large cylinder diameters of the first drying module or modules, in the initial part of the dryer section, on the different cylinders, drying energies higher than average and longer dwell times of the web become available, and thereby quantities of water larger than average can be evaporated per unit of length of the dryer in the machine direction. In this manner, in the initial part of the dryer section, the dry solids content and the strength of the web can be raised rapidly to a level at which a reliable transfer of the web can be accomplished, also by means of open draws of the web if necessary. Moreover, when the larger cylinder diameters are employed, the centrifugal forces that tend to separate the web from the drying wire are lowered. For this reason, it is also possible to employ lower levels of negative pressure at the cylinders which is advantageous both in view of the cost of equipment and in view of the cost of energy.

The hybrid drying method and the hybrid drying modules in accordance with the present invention are also particularly well suited for modernizations of existing dryer sections. In this case, one or more hybrid drying modules in accordance with the invention are arranged over a part of the length of the dryer section, preferably in the initial end of the dryer section. The drying capacity per unit of length in the machine direction of the drying modules is, on average, higher than in the dryer section to be modernized.

After the hybrid drying modules, it is possible to use the existing multi-cylinder dryer which comprises preferably several wire groups. Some of these wire groups may be new groups with a single-wire draw and/or, in the final end of the dryer section, it is possible to employ the old cylinder groups that belong to the final end of the dryer section to be modernized. In this arrangement, the final end of the dryer section is more advantageous than a prior art dryer section having only groups with a single-wire draw, either so-called normal groups and, between them, corresponding inverted groups, or exclusively so-called normal groups. Also, the last group and/or penultimate group may consist of a group with a twin-wire draw in which the web has free draws between the rows of contact-drying cylinders, on which draws the web is relaxed. As the last group or groups, it is preferable to use a group with a twin-wire draw, because, at that point, the web is sufficiently dry and strong so that the free draws of the web do not produce a detrimental risk of web break.

In another embodiment, there are between 3 and 12 drying modules in the dryer section arranged adjacent to one another, at least two adjacent drying modules have a common drying wire, and the suction roll functions to transfer the web in group gaps as a closed draw.

BRIEF DESCRIPTION OF THE DRAWINGS

The following drawings are illustrative of embodiments of the invention and are not meant to limit the scope of the invention as encompassed by the claims.

FIG. 9 illustrates arrangements of the circulation of the drying gas in connection with the hood of a blowing-on and/or through-drying cylinder.

FIG. 10 shows arrangements of the circulation of the drying and blowing gases passed into connection with a module in accordance with the present invention.

FIG. 11 is a sectional view taken along the line XI—XI in FIGS. 9 and 10.

DETAILED DESCRIPTION OF THE INVENTION

Figure 1:
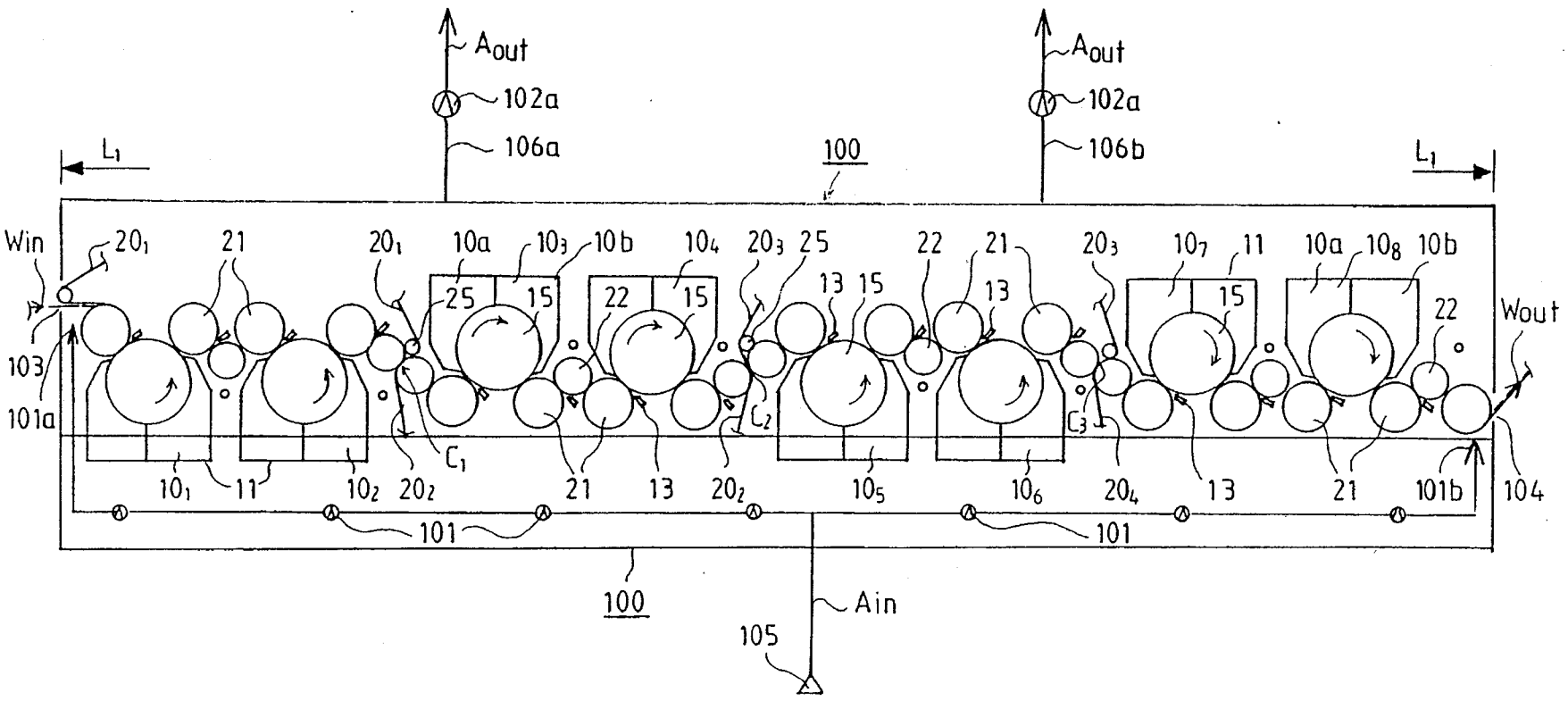
FIG. 1 is a schematic side view of a dryer section in accordance with the present invention.

Accordingly, an example of the construction of a drying module 10 in accordance with the present invention will be described mainly with reference to FIGS. 5 and 9. As shown in these Figures, the drying module 10 comprises a large-diameter $D_1$ blowing-on and/or through-drying cylinder 15 for which the designation "large cylinder" will be used. A mantle 16 of the large cylinder 15 is provided with through perforations and/or with grooves in its outside face (as shown in FIG. 11). Negative pressure can be produced in grooves 16R through the perforations in the mantle 16, or otherwise, to keep the web W on a face of a drying wire 20 on a sector a of the large cylinder 15. The drying module 10 includes a pair of contact-drying cylinders 21 placed in proximity to the large cylinder 15 on both sides of the large cylinder 15. The contact-drying cylinders 21 have a smooth outer face 21' heated from the interior. For these cylinders 21, in the following, the designation "contact cylinder" will be used since the web W to be dried is pressed by the drying wire 20 into direct contact against the cylinders 21. In contrast thereto, on the sector a of the large cylinder 15, the web W is placed on the drying wire 20 at the side of the outside curve, i.e., not in contact with the cylinders. Further, the drying module 10 includes one or more reversing suction cylinders or rolls 22 which are provided with through perforations. In the following, the designation "suction roll" will be used for these cylinders 22.

The large cylinders 15 and suction rolls 22 are most appropriately VAC™ rolls described in the assignee's Finnish Patent No. FI 83,680 (corresponding to U.S. Pat. No. 5,022,163) or equivalent, which are provided with perforations 16P passing through the roll mantle and opening into the grooves 16R in the outer face of the roll mantle (FIG. 11). In the grooves 16R, negative pressure is produced from the negative pressure $p_0$ present in the interior of mantles 16;23 of the large cylinder 15 and of the suction roll. Negative pressure $p_0$ is again produced through suction ducts 18,28*a* placed in the axle journal of the large cylinder 15 and the suction roll 22 by means of a vacuum pump 37;38 (FIGS. 9 and 10).

The drying module 10 also includes a drying wire 20 which is guided by the guide rolls 25, in addition to meandering around the other rolls in the drying module.

The permeability of the wire, i.e., the penetrability of the wire by air, is selected to be suitable in view of the invention. In successive different drying wires, e.g., in different drying modules, it is possible to use different permeabilities and different wire tensions in the machine direction.

In a module 10 in accordance with the invention, in the first stage, the paper web W is dried by pressing it by means of the drying wire 20 against the cylinder face 21' of cylinder 21 (the contact-drying step). The diameter $D_2$ of cylinder 21 is typically greater than about 1.5 m and the paper web runs over a sector b of cylinder 21 whose magnitude is greater than about 180°. In the next stage, the paper web W is evaporation-dried by means of blowing-on/through-drying (the evaporation-drying step). This is achieved by directing at the web a set of high-velocity drying-gas jets ($v_9$ is in a range from about 20 m/s to about 150 m/s ) operating while the web is on support of the drying wire 20 on the face of the large cylinder 15. Cylinder 15 has a diameter $D_1$ which is greater than about 2 m while the web W is placed at the side of the outside curve on the sector a which is greater than about 180° preferably over the area of the entire sector a. Thereafter, the first step defined above is repeated, i.e., the paper web W is dried by pressing it by means of the drying wire 20 against the cylinder face 21' of cylinder 21, etc.

Before the first stage and/or after the last-mentioned stage, the web W to be dried is passed over a suction sector c of the suction roll 22 while the web W is on support of the drying wire 20 at the side of the outside curve (the suction-drying step). The magnitude of the suction sector c is selected to be greater than about 160° and the diameter $D_3$ of the suction roll 22 is selected so that $D_3<D_2$.

In the embodiments wherein blowing-on drying is used, the velocity range ($v_g$) of the set of drying-gas jets that is used is preferably in a range from about 80 m/s to about 130 m/s. When through-drying is used, the velocity range ($v_g$) is in a range from about 20 m/s to about 60 m/s.

The diameters of the cylinders and rolls 15,21,22 and 25 mentioned above are denoted by references $D_1$, $D_2$, $D_3$ and $D_4$, respectively. In a drying module 10 in accordance with the invention, preferably, $D_1>D_2>D_3>D_4$. Moreover, it is advantageous that the ratios $D_1/D_2$ and $D_2/D_3$ should be within the following ranges: $D_1/D_2$ is from about 1.0 to about 2.2, preferably $D_1/D_2$ is from about 1.5 to about 1.7, $D_2/D_3$ is from about 1.1 to about 2.2, preferably $D_2/D_3$ is from about 1.2 to about 1.6, and $D_3/D_4$ is from about 1.0 to about 2.5, preferably $D_3/D_4$ is from about 1.5 to about 2.0.

The drying module 10 in accordance with the invention is arranged to be as compact as possible, especially in the horizontal direction, i.e., in the machine direction. To this end, horizontal dimensions $l_{10}$ and $l_{11}$ of the dryer module illustrated in FIG. 5 are preferably selected as follows: $l_{11}$ is from about 0.8 to about 4.0 times $D_1$, preferably $l_{11}$ is $(1.8–3.0)\times D_1$. The height dimensions $h_1$ and $h_2$ are preferably arranged so that $h_2$ is $(0.1–1.1)\times D_2$ and $h_1/h_2$ is from about 2 to about 10, preferably $h_1/h_2$ is in a range from about 3 to about 6.

In the module 10 in accordance with the invention, the turning sectors of the drying wire 20 and the web W on the rolls 15 and 21 are selected preferably so that a (the turning sector on roll 15) is in a range from about 180° to about 320°, preferably from about 220° to about 300°. Sector b (the turning sector on roll 21) is from about 180° to about 300°, preferably from about 210° to about 260°. The turning sector c of the web W on the suction roll 22 (in FIG. 5) between the modules $\mathbf{10}^2$ and $\mathbf{10}^3$ is from about 160° to about 300°, preferably from about 200° to about 270°.

FIG. 1 shows a dryer section of a paper machine that consists of drying modules 10 described above. The dryer section is intended typically for drying a web running at a web speed of from about 30 m/s to about 40 m/s. The entire dryer section is placed inside a hood 100. The paper web W is passed into the interior of the hood 100 in the direction of arrow $W_{in}$ through an opening 103 in the hood 100. The web is removed out of the hood 100 in the direction of arrow $W_{out}$ at the final end of the dryer section through an opening 104. In the hood 100, in a manner in itself known, air-conditioning is provided (illustrated by air inlet duct 105), through which dry and possibly heated air is passed through nozzles 101 and 101*a* and 101*b* into the hood. Air is removed out of the hood 100 through ducts 106*a* and 106*b*. Exhaust-air flows are produced by means of blowers 102*a* and 102*b*. The moist air is removed in the direction of arrows $A_{out}$ into the open air through heat recovery equipment.

Referring to FIG. 1, in the direction of arrival of the web $W_{in}$, the dryer section comprises two "inverted" drying modules $\mathbf{10}_1$ and $\mathbf{10}_2$ in which the large cylinders 15 and their respective hoods 11 are placed underneath and the pairs of contact cylinders 21 are placed above. The inverted modules $\mathbf{10}_1,\mathbf{10}_2$ have a common drying wire $\mathbf{20}_1$ which carries the web W as a fully closed draw through the inverted group $\mathbf{10}_1,\mathbf{10}_2$. Thereafter, the web W is transferred as a closed group-gap draw $C_1$ onto the drying wire $\mathbf{20}_2$ of the following "normal" module group $\mathbf{10}_3,\mathbf{10}_4$. From drying wire $\mathbf{20}_2$, the web is transferred as a closed group-gap draw $C_2$ onto the drying wire $\mathbf{20}_3$ of the following inverted module group $\mathbf{10}_5,\mathbf{10}_6$. From the drying wire $\mathbf{20}_3$ , the web W is transferred as a closed group-gap draw $C_3$ on the drying wire $\mathbf{20}_4$ of the last "normal" module group $\mathbf{10}_7,\mathbf{10}_8$.

In FIG. 1, the overall length of the dryer section is denoted by reference $L_1$. Typically, the length $L_1$ of a dryer section as shown in FIG. 1 is from about 40 meters to about 60 meters.

According to the description provided above, the evaporation speed per unit of length times width, i.e., per floor area covered by the web to be dried is from about 100 kg $H_2O/m^2/h$ to about 160 kg $H_2O/m^2/h$. This speed illustrates the compactness of the dryer section, i.e., the efficiency of utilization of the longitudinal space. In prior art corresponding multi-cylinder dryers, the evaporation speed is in a range from about 50 kg $H_2O/m^2/h$ to about 80 kg $H_2O/m^2/h$. In FIG. 1, about 75 percent to about 80 percent of the drying length $L_w$ of the web W is either on the sectors a of the large cylinders 15 subjected to a blowing-on/through-drying effect or on the cylinders 22 subjected to a drying effect of the contact-drying face. The corresponding percentage in typical prior art multi-cylinder dryers is in a range from about only 45% to about 65%.

Figure 2:
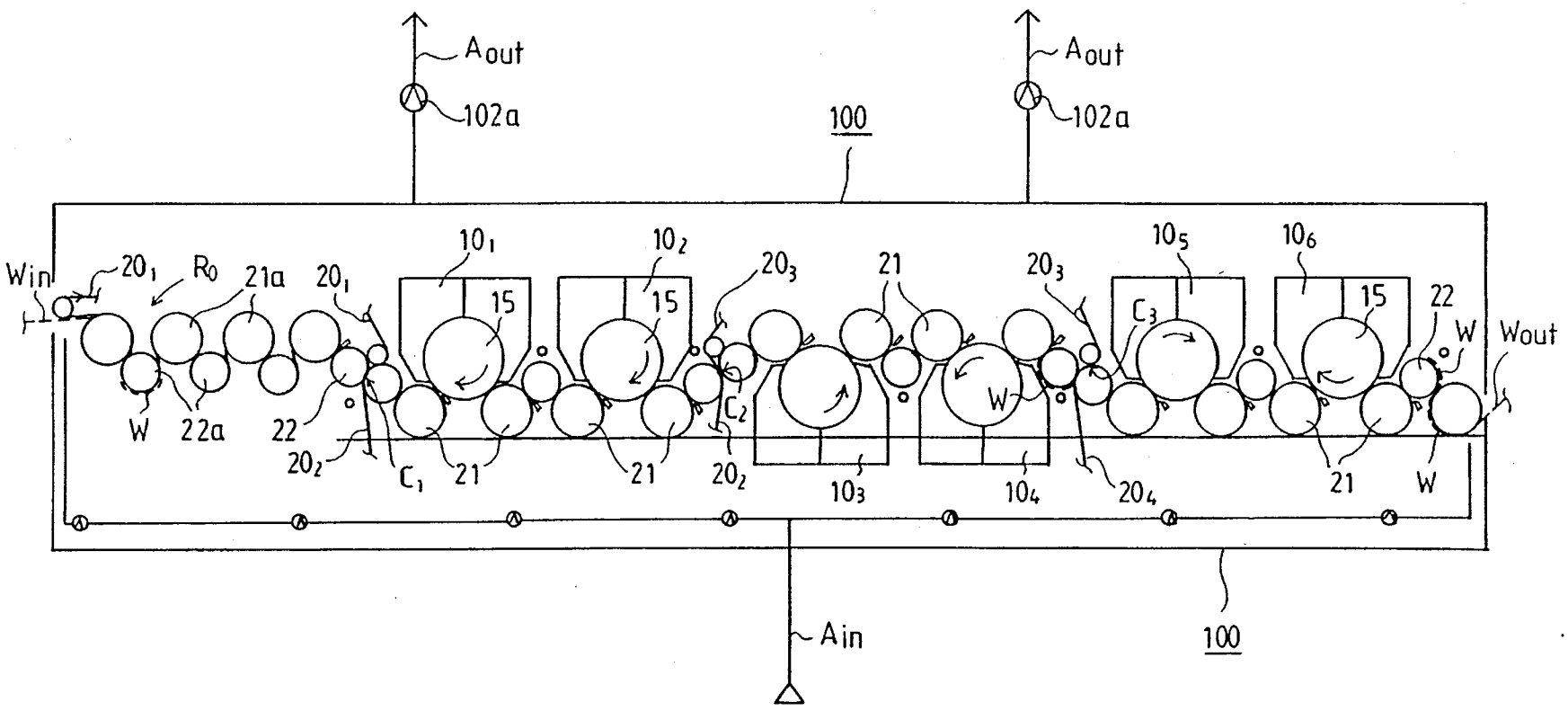
FIG. 2 shows a modification of the dryer section as shown in FIG. 1 in which there is one normal group of drying cylinders having a single-wire draw at the initial end of the dryer section,.

The embodiment shown in FIG. 2 is a modification of the dryer section shown in FIG. 1 and illustrates a hybrid dryer having a normal group $R_0$ of drying cylinders in the initial part of the dryer section. In the normal group $R_0$, the contact-drying cylinders 21*a* are placed in the upper row, the reversing suction rolls 22; 22*a* are placed in the lower row, and the transfer of the web through the group $R_0$ takes place on the drying wire $\mathbf{20}_1$ as a single-wire draw. This group is followed by a wire group in accordance with the invention, which consists of two successive drying modules $\mathbf{10}_1$ and $\mathbf{10}_2$ in accordance with the invention and is provided with a drying wire $\mathbf{20}_2$, and thereafter by an "inverted" wire group consisting of the modules $\mathbf{10}_3$ and $\mathbf{10}_4$. Modules $\mathbf{10}_3$ and $\mathbf{10}_4$ are followed by a "normal" wire group consisting of the modules $\mathbf{10}_5$ and $\mathbf{10}_6$ and provided with a drying wire $\mathbf{20}_4$.

In the present invention, the web W to be evaporation-dried is supported by the drying wires $\mathbf{20}_1 \ldots \mathbf{20}_N$ over its entire length $L_w$, and the transfer from a drying wire 20 onto the next drying wire takes place as fully closed group-gap draws $C_1$, $C_2$, and $C_3$. When drying modules in accordance with the invention are used, the web W can also be transferred from one drying wire onto another drying wire by using short open group-gap draws, i.e., less than about 0.5 meters in length. In other respects, the embodiment shown in FIG. 2 is similar to that shown in FIG. 1 and the same reference numerals are used to denote the same elements.

Figure 3:
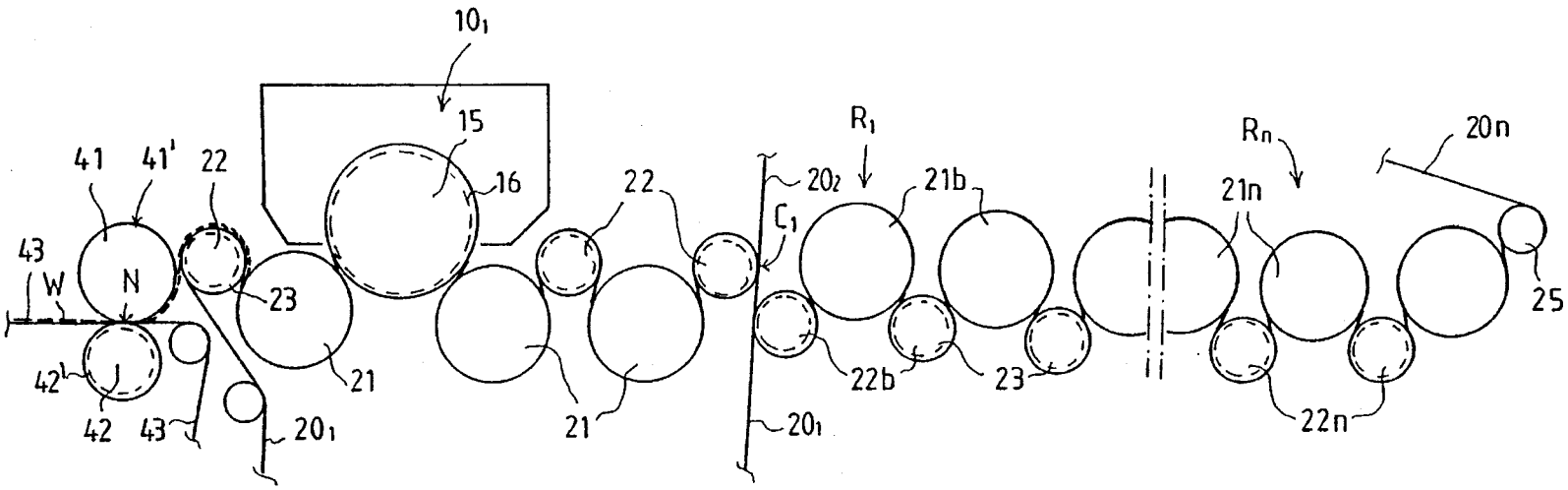
FIG. 3 shows a modification of the present invention in which the first drying group is a drying module in accordance with the present invention, and is followed by normal groups of drying cylinders having a single-wire draw.

FIG. 3 shows a hybrid dryer in accordance with the invention, in which the web W is passed through a last press nip N in the press section to the dryer section in accordance with the invention. The press nip N is formed between an upper roll 41 having a smooth-face 41' and a lower roll 42 having a grooved-face 42'. After the nip N, the web W follows the smooth roll face 41', from which it is transferred onto the suction roll 22, which belongs to the first drying module $\mathbf{10}_1$ in accordance with the invention. After passing through module $\mathbf{10}_1$, the web W is transferred over the contact cylinders 21 and the suction rolls 22 from the first drying wire 20, as a closed group-gap draw $C_1$ onto the second drying wire $\mathbf{20}_2$. The second drying wire $\mathbf{20}_2$ is included as part of a normal group of a multi-cylinder dryer in which drying cylinders 21*b* are placed in the upper row and reversing suction rolls 22*b* are placed in the lower row. The number of these normal groups $R_1, \ldots, R_N$ is sufficiently high. The upper cylinders in the last group are denoted by reference $\mathbf{21}_n$, the suction rolls with reference $\mathbf{22}_n$, and the drying wire with reference $\mathbf{20}_n$.

Figure 4:
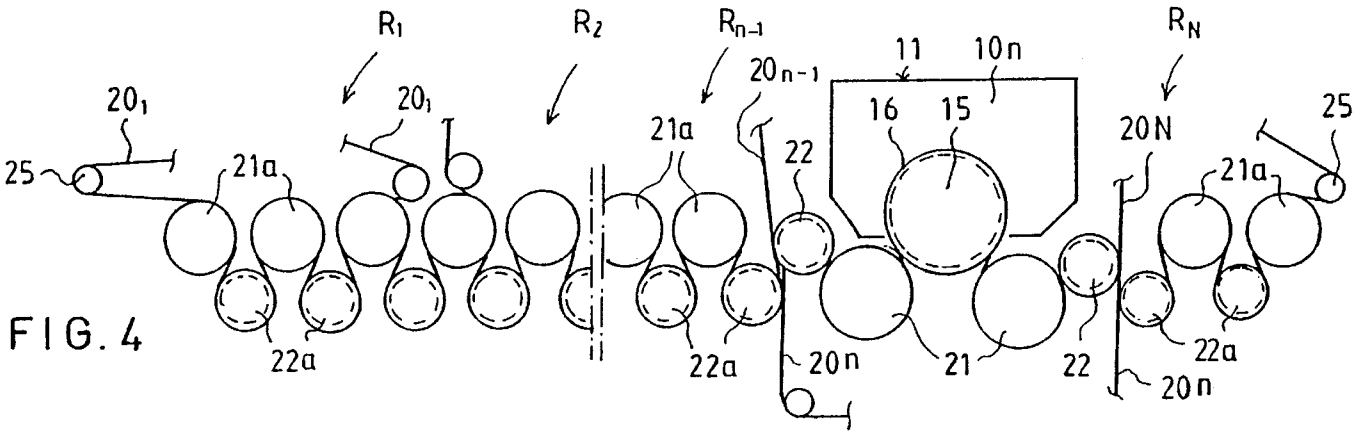
FIG. 4 shows a modification of the present invention in which a drying module in accordance with the invention is arranged in the final end of the dryer section in place of a prior art so-called inverted cylinder group.

FIG. 4 shows a hybrid dryer in which there are prior art normal cylinder groups $R_1, \ldots, R_{n-1}$ in the initial part of the dryer. In these normal cylinder groups, the contact-drying cylinders 21*a* are arranged in the upper row and the reversing cylinders 22*a* are arranged in the lower row, and between the groups $R_1$ and $R_2$, etc. there is preferably a closed draw. The number of groups $R_i$ is n–1, after which, in the location in which there would be a so-called inverted group in prior art multi-cylinder dryers, there follows a "normal" drying module $10_7$ in accordance with the invention. In module $10_n$, the large cylinder 15 is placed above the pair of contact cylinders 21 which are placed underneath the cylinder 15. After the module $10_n$, there still may follow a "normal" cylinder group $R_N$, whose drying wire is denoted by reference $20_N$.

From the above description of the embodiments of FIGS. 2, 3 and 4, various so-called hybrid dryers are formed by means of the modules 10 in accordance with the present invention. There are one or several modules 10 at suitable locations, and, moreover, in a hybrid dryer, there are groups of drying cylinders, preferably such "normal" groups R in which the contact-drying cylinders 21*a* are arranged in the upper row and the reversing suction rolls 22 are arranged in the lower row. However, if necessary, it is also possible to use so-called inverted groups in the hybrid dryer, even though in such inverted groups, when web breaks occur, difficulties are encountered in the handling of paper broke.

Figure 5:
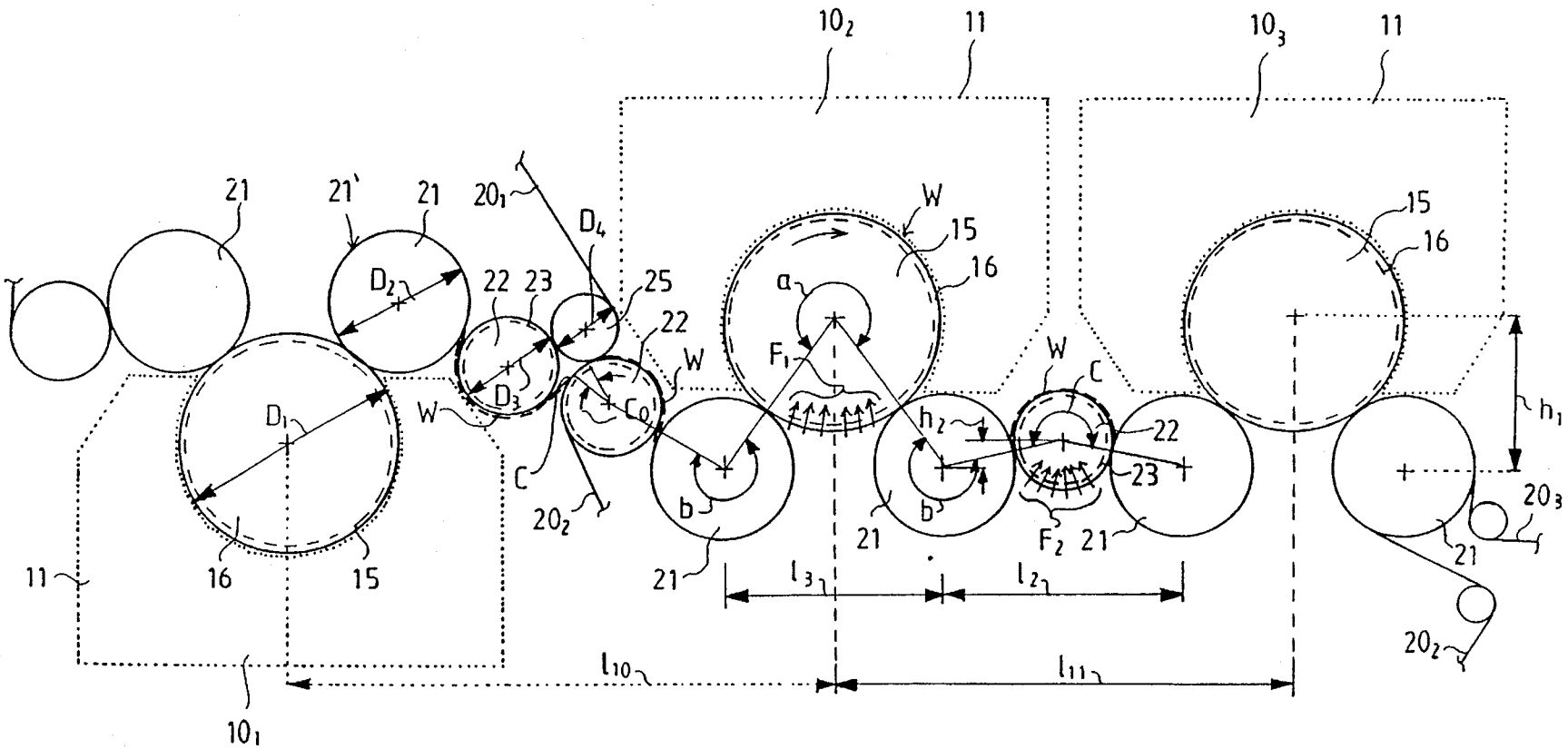
FIG. 5 shows a preferred geometry of a drying module in accordance with the present invention as well as important parameters of dimensioning and a combination of evaporation means consisting of three successive modules.

The most important dimensioning parameters of the construction of a group of modules $10_1$,$10_2$,$10_3$ as shown in FIG. 5 have already been described above. In FIG. 5, the first module $10_1$ is a so-called inverted module in which the large cylinder 15 is placed underneath in a lower position and the pair of contact cylinders 21 are placed above the cylinder. The web W is transferred from the face of the drying wire 20 onto the face of the wire $20_2$ which runs over the first suction roll 22 in the module $10_2$, on the sector $C_0$. Thereafter, the web W is transferred on the suction roll 22, while being held by the negative pressure present in the grooves 16R in the roll mantle (FIG. 11), onto the next contact cylinder 21. The web is pressed against the heated smooth face 21' of cylinder 21 by the effect of the tension of the wire 20 on the sector b. The web W is transferred substantially directly onto the grooved 16R face of the large cylinder 15. The web is held on the grooved face by the effect of the negative pressure present in the grooves 16R and/or by the effect of the pressure present in the hood 11.

The drying sector a of the large cylinder 15 is as large as possible, preferably about 300°. After the sector a, the web W is transferred substantially directly onto the next contact-drying cylinder 21, and after its maximally large drying sector b, the web is transferred by the reversing suction roll 22 to the next drying module 103. Preferably, the magnitude of sector b is about 270°.

Figure 6:
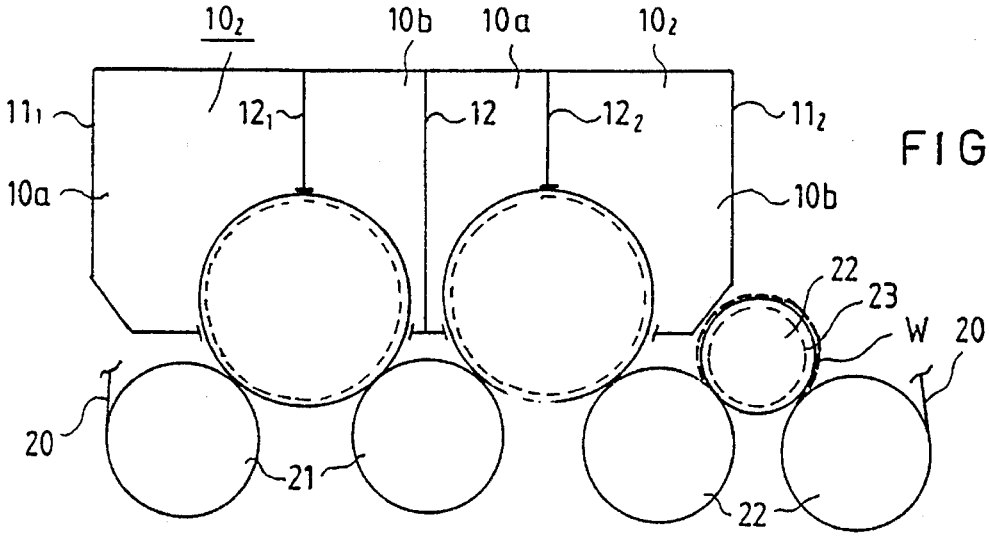
FIG. 6 shows such a drying module in accordance with the present invention in which two blowing-on/blowing-through hoods are connected together.

FIG. 6 shows a pair of drying modules $10_1$,$10_2$ in which the hoods $11_1$ and $11_2$ of both of modules are divided by partition walls $12_1$ and $12_2$ into two compartments 10*a* and 10*b*. The pair of hoods $11_1$,$11_2$ of the drying module $10_1$,$10_2$ have a common vertical partition wall 12, which runs at, or in the area of, the center of rotation of the contact cylinder 21 placed underneath the hoods. In other respects, the embodiment of FIG. 6 can be used in a dryer section in accordance with the present invention and includes additional rolls, e.g., large cylinders, reversing rolls 22, contact cylinders 21, as the other drying modules in accordance with the invention.

Figure 7:
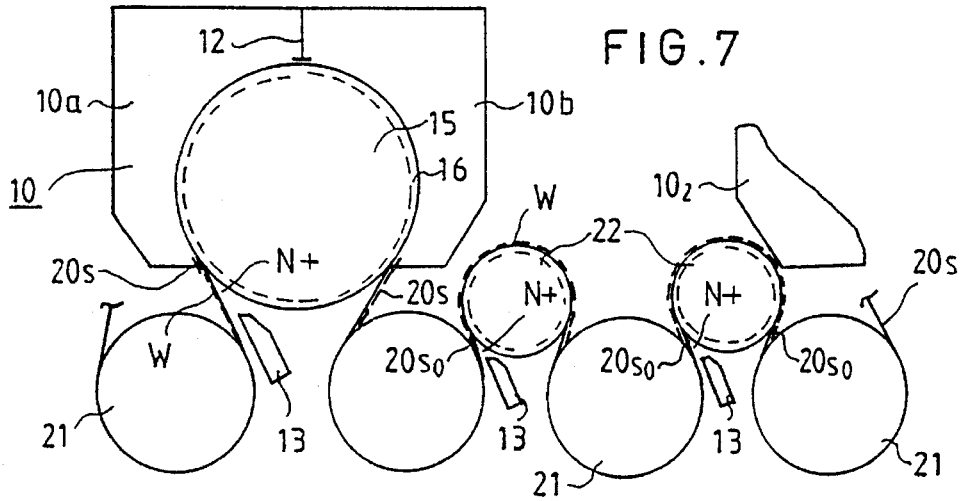
FIG. 7 shows a modification of the present invention in which there are straight joint runs of the drying wire and the web between the drying cylinders and the blowing-on and/or through-drying cylinders and the reversing suction rolls.

FIG. 7 shows another embodiment of a drying module 10 in accordance with the present invention in which the drying wire 20 and the web W have relatively short straight draws 20S between the large cylinder 15 and the contact cylinders 21. Between the contact cylinders 21 and the suction roll 22, the drying wire 20 also has very short straight draws $20S_0$. In the areas of the straight draws 20S,$20S_0$, it is possible to arrange conventional ejection blow boxes 13 having air blowings directed to prevent induction of pressures in the closing nip spaces N+. Otherwise, in the contrary case, the pressures would cause separation of the web W from the drying wire 20 at the nips N+. Besides the blowing-on and/or through-drying roll, the drying module shown in FIG. 7 comprises three contact cylinders 21 and two reversing rolls 22.

Figure 8:
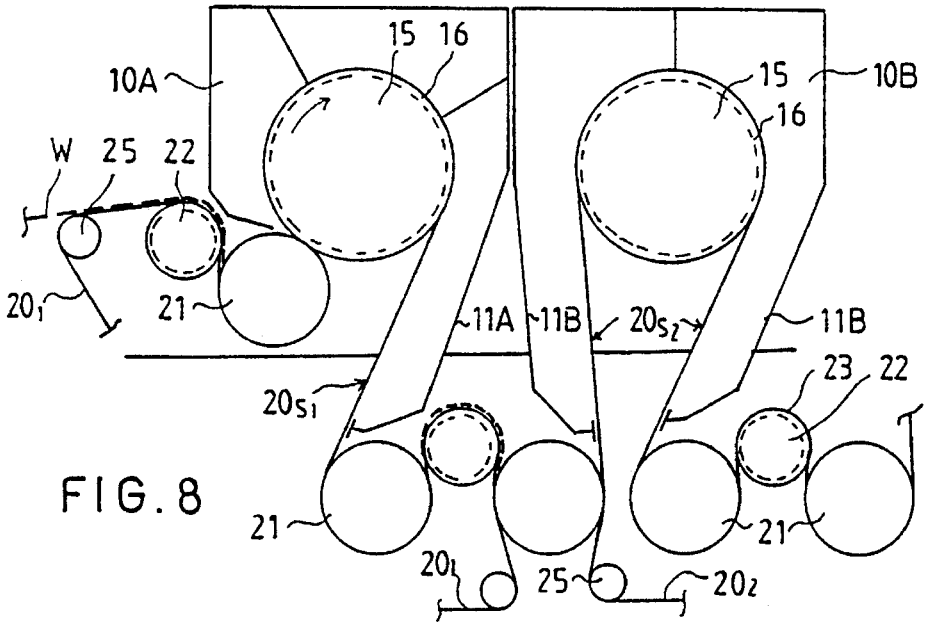
FIG. 8 shows a modification of the drying module in accordance with the present invention in which there are two successive blowing-on/blowing-through cylinders and hoods situated above them, the hoods having projection parts extending over the straight runs of the drying wire and the web.

The pair of drying modules 10A and 10B in another embodiment of the present invention shown in FIG. 8 have a height substantially larger than those described above so that the height of the machine hall can be utilized efficiently. The large cylinders 15 and the contact cylinders 21 placed below them are arranged at considerably high levels, so that between the large cylinders 15 and the contact cylinders 21, the wire 20 and the web W have relatively long straight draws $20S_1$ and $20S_2$. In connection with the straight draws, projection parts 11A and 11B of the drying hoods 11 are extended. In the areas of the projection parts 11A and 11B, blowing-on and/or blowing-through drying of the web W takes place by means of sets of drying-gas jets. In the other respects, the pair of modules 10A,10B illustrated in FIG. 8 is similar to what has been described above. In FIG. 8, the drying cylinders 21 and the reversing suction rolls 22 are placed at a substantially lower level than the other drying apparatuses, whereby the available space of height has been utilized even more efficiently.

FIG. 9 shows the construction of the hood 11 placed around the large cylinder 15 and the arrangement of circulation of the drying gas, such as air or superheated steam. The hood 11 is divided by a partition wall 12 into two compartments 10*a* and 10*b*. A hot drying gas, e.g., air, is passed into the compartments 10*a*,10*b* through feed pipes 31 from which the drying air is distributed through a duct 41 into a nozzle chamber 40. Nozzle chamber 40 is defined from outside by a curved wall 42 and from inside by a nozzle field 43 which is placed at a distance of a very small gap a from the outer face of the web W running on the drying wire 20. The gap Δ is about 10 mm to about 60 mm wide, preferably from about 20 mm to about 30 mm.

The large cylinder 15 includes a mantle 16 with through perforations 16P and outside grooves 16R. The through perforations 16P opens into the grooves as shown in FIG. 11. The interior of the large cylinder 15 communicates with a suction pipe 19 through a suction duct 18 placed in connection with a support 17 of one axle journal of the cylinder. Suction pipe 19 communicates with a suction pump 37 as shown in FIG. 10 to produce a negative pressure in the grooves 16R in the mantle 16, $p_o$ being from about 0.5 kPa to about 20 kPa.

In a through-drying process, a substantially similar arrangement of the cylinder and hood is used. However, the open area of the mantle of the large cylinder 15 is considerably large, at the same time as a considerable negative pressure is produced in the roll in the portion that is covered by the web, $p_o$ being from about 5 kPa to about 50 kPa.

In a preferred embodiment of the invention, the web is subjected to a difference in pressure $\Delta P_1$ on the sector a of the large cylinder 15. The pressure differential $\Delta P_1$ presses the web W to be dried against the drying wire 20 while the web W is placed at the side of the outside curve and tends to be separated from the drying wire 20 by the effect of centrifugal forces which are proportional to the factor $2 \cdot v^2/D_1$. These separating forces are counteracted by means of the difference in pressure $\Delta P_1$ effective between the outer face of the web and the grooves 16R in the mantle 16 of the large cylinder 15. This difference in pressure $\Delta P_1$ generally has a magnitude in a range from about 1 kPa to about 4 kPa.

For a corresponding purpose, on the sector c of the reversing suction rolls 22, in which the web W is placed at the side of the outside curve, a difference in pressure $\Delta P_2$ is used, which has a magnitude of from about 1 kPa to about 4 kPa. These differences in pressure $\Delta P_1$ and $\Delta P_2$ are produced by means of negative pressure passed into the interior 22 of the large cylinder 15 and the reversing suction roll 22 through a suction duct 17,18,38*a* placed in connection with an axle journal of the cylinder or roll. The negative pressure also produces leakage flows $F_1$,$F_2$ outside the sectors a and c, to be described in the following.

As indicated in FIGS. 5, 9 and 10, a leakage flow $F_1$ takes place through the cylinder mantle 16 towards the interior of the cylinder on the sector 360°-a of the large cylinder 15, i.e., on the sector that is not covered by the drying wire 20. By suitably dimensioning the throttle in the through perforations 16P, i.e., of the resistance to flow, this leakage flow $F_1$ can be brought to a level such that it does not disturb the formation of a sufficient difference in pressure $\Delta P_1$ in the grooves 16R. A corresponding leakage flow also takes place on the free sectors 360°-c of the suction rolls 22, and this flow is denoted by $F_2$ in FIGS. 5 and 10. The large cylinder 15, and also the reversing suction rolls 22, may also be provided with inside suction boxes and sealing members to minimize the respective leakage flows.

FIG. 10 is a schematic illustration of an exemplifying embodiment of the arrangement of circulation of the drying gases and blow airs in connection with a large cylinder 15 placed in a drying module or dryer section in accordance with the present invention. Inlet flows $B_{in}$ are passed through inlet air ducts 30 into the compartments 10*a* and 10*b* of the hood 11. The physical state of the inlet gas passed into different compartments 10*a* and 10*b* may be different. The inlet flows $B_{in}$ are regulated by means of regulation dampers 31 or other suitable regulation means. From the nozzle field 43, high-energy hot drying-gas flows are applied at a high velocity ($V_9$ being from about 50 m/s to about 150 m/s) to the outer face of the web W, whereby so-called blowing-on drying or "impingement" drying is produced.

In the embodiment wherein through-drying is applied through the hood, part of the drying gas passes in the direction of the arrows $B_1$ through the web W, the drying wire 20, and through the mantle 16 of the large cylinder 15 into the interior of the large cylinder 15. In large cylinder 15, a negative pressure is produced by the pump 37 ($p_o$ being from about 5 kPa to about 50 kPa). This negative pressure is illustrated by arrow $B_2$ in the suction pipe 19.

Referring again to FIG. 10, the air blowings of the ejection blow boxes 13 are passed out of a blower 36 in the direction of arrows $B_3$ and are arranged to prevent the formation of pressure in the closing nip spaces N+. One of the axle journals of the suction rolls 22 includes a suction duct 38*a* through which a suction flow is passed or drawn in the direction of the arrows $B_5$ out of the interior spaces in the cylinders 22 by means of the suction pump 38. In this manner, negative pressure is produced on the outer face of the perforated 16P and grooved 16R mantle 23 of the cylinder 22. By means of the negative pressure, the web W is held in connection with the cylinder 22 and the drying wire 20 as it runs on the sectors c at the side of the outside curve. Further, FIG. 10 shows that a replacement air flow is passed by means of the blower 39 in the direction of arrow $B_4$ through the duct 14 to constitute replacement air for the hood 100. The duct 14 corresponds to the blow nozzles $\mathbf{10}_1$ shown in FIGS. 1 and 2.

FIG. 11 shows axial sectional views of the mantle 16,23 of the large cylinder 15 and the reversing suction roll 22 taken along the lines XI—XI in FIGS. 9 and 10. The mantles 16,23 include annular grooves 16R passing around their outer faces. The depth of the grooves is denoted by reference $r_o$, the width of the grooves is denoted by reference $l_o$, and the mantle portions having a full wall thickness, placed between the grooves, are denoted by reference $l_1$. The perforations or holes 16P that pass through the mantle 16,23 open into the bottoms of the grooves 16R. The diameter of the holes is denoted by reference $\phi$, and the full thickness of the mantle 16,23 is denoted by reference $r_1$. In the following, a preferred example of the dimensions of a grooved mantle as shown in FIG. 11 will be given: $r_o$ is about 5 mm, $l_o$ is about 5 mm, $r_1$ is about 20 mm, $l_1$ is about 15 mm and $\phi$ is about 4 mm. The frequency of the perforations 16P and the diameter $\phi$ thereof are preferably selected so that the percentage of holes of the groove 16R bottoms is about 1 percent to about 3 percent of the total area.

Figure 12:
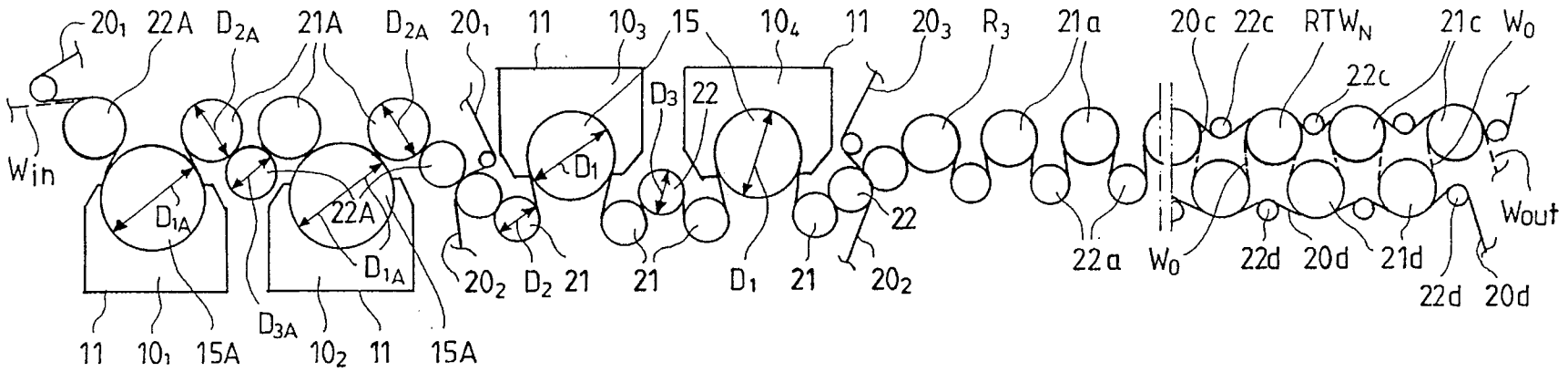
FIG. 12 shows a variation of the invention in which cylinder diameters larger than average are employed in the first drying module.

FIG. 12 shows a preferred variation of the invention in which, in the first two drying modules $\mathbf{10}_1$ and $\mathbf{10}_2$ placed in the initial part of the dryer section, larger diameters $D_{1A}$, $D_{2A}$ and $D_{3A}$ of the cylinders 15A,21A,22A are used in comparison to the subsequent two drying modules $\mathbf{10}_3$ and $\mathbf{10}_4$ in which the corresponding cylinder diameters are denoted by $D_1$, $D_2$ and $D_3$. The first drying modules $\mathbf{10}_1$ and $\mathbf{10}_2$ have a common drying wire $\mathbf{20}_1$, and, in a corresponding manner, the following two drying modules $\mathbf{10}_3$ and $\mathbf{10}_4$ have a common drying wire $\mathbf{20}_2$. By providing the cylinder diameters $D_{1A}$, $D_{2A}$ and $D_{3A}$ larger than average, the web W to be dried can be given longer dwell times, so that quantities of water larger than average can be evaporated per horizontal unit of length of the dryer section in the machine direction by means of the modules $\mathbf{10}_1$ and $\mathbf{10}_2$. This corresponds to an increase in the intensity of drying vis-a-vis the larger cylinder diameters in the initial part of the dryer section. In this manner, in the modules $\mathbf{10}_1$ and $\mathbf{10}_2$, the dry solids content and the strength of the web W to be dried can be raised rapidly to an adequate level so that, if necessary, it is also possible to start using free gaps in the subsequent stages of drying. Owing to the larger diameters $D_{1A}$, $D_{2A}$ and $D_{3A}$ of the cylinders 15A,21A,22A, it is also possible to employ lower levels of negative pressure in the cylinders 15A and 22A which is advantageous in view of both the cost of equipment and the cost of energy.

In the following table, a preferred exemplifying embodiment will be given concerning the dimensioning of the diameters $D_{1A}$, $D_{2A}$, $D_{3A}$, $D_1$, $D_2$, and $D_3$ of the cylinders 15A, 21A, 22A, 15, 21, 22, respectively, shown in FIG. 12.

| | | |
|---|---|---|
| $D_{1A} \approx 3.2$ m | $D_{2A} \approx 2.4$ m | $D_{3A} \approx 1.8$ m |
| $D_1 \approx 2.4$ m | $D_2 \approx 1.8$ m | $D_3 \approx 1.5$ m |

If the ratio of the cylinder diameters in the first drying modules $\mathbf{10}_1$,$\mathbf{10}_2$ and in the following drying modules $\mathbf{10}_3$, $\mathbf{10}_4$ is denoted by reference k, preferably $$k=D_{1A}/D_1 \approx D_{2A}/D_2 \approx D_{3A}/D_3$$

In the present invention, the ratio k mentioned above is preferably in a range from about 1.2 to about 1.5, depending on the application and the paper quality being produced by the dryer section. The cylinder diameters $D_1$,$D_2$ and $D_3$ in the latter drying modules $\mathbf{10}_3$ and $\mathbf{10}_4$ are selected so that the dryer construction and the drying process are optimized both in view of the paper quality produced, the runnability, and the machine construction. In this regard, the first modules $\mathbf{10}_1$ and $\mathbf{10}_2$ are provided with substantially larger cylinder diameters $D_{1A}$, $D_{2A}$ and $D_{3A}$ for the reasons given above.

Referring again to FIG. 12, the drying modules $\mathbf{10}_1$,$\mathbf{10}_2$, $\mathbf{10}_3$ and $\mathbf{10}_4$ are followed by a prior art drying group $R_3$ having a single-wire draw, a drying wire denoted by reference 23, contact-drying cylinders arranged in the upper row and denoted by reference 21*a*, and reversing suction rolls arranged in the lower row and denoted by reference 22*a*.

In the embodiment shown in FIG. 12, as the last group $RTW_N$ in the dryer section, a group with a twin-wire draw in itself known is used. In group $RTW_N$, the web W has free unsupported draws $W_O$ between the rows of contact-drying cylinders 21*c* and 21*d*. In the group $RTW_N$, there is also an upper wire 20*c* which is guided by guide rolls 22*c* arranged in gaps between the drying cylinders 21*c*, and a corresponding lower wire 20*d* which is guided by guide rolls 22*d* arranged in gaps between the drying cylinders 21*d* in the lower row.

The dryer section shown in FIG. 12 is particularly well suited for modernizations of existing dryer sections in which the groups $R_3, \ldots, R_n$ with a single-wire draw and/or the group $RTW_N$ with a twin-wire draw are horizontal groups in the final end of the dryer section to be modernized and the old groups in the initial end are replaced by drying modules $\mathbf{10}_1$,$\mathbf{10}_2$,$\mathbf{10}_3$ and $\mathbf{10}_4$ in accordance with the invention. By means of such replacement, the drying capacity and the runnability can be increased so that the web speed in the dryer section can be increased to the level required by the modernization of the paper machine. The groups $R_3, \ldots, R_n$ and $RTW_N$ may also be groups of other sorts which either are included in the groups in the rear end of the dryer section to be modernized or are new constructions. The concept shown in FIG. 12 can also be applied so that the groups $R_3, \ldots, R_n$ and/or $RTW_N$ are substituted for by one or more drying modules $\mathbf{10}_5, \ldots, \mathbf{10}_N$ in accordance with the present invention.

In the drying methods and dryer sections in accordance with the present invention, it is also possible to provide an arrangement for the control and regulation of the transverse drying profile of the paper. This can be accomplished so that one or more drying modules 10 are provided with a hood 11 for a blowing-on and/or through-drying cylinder 15. The hood is divided into several blocks in the transverse direction of the machine, preferably by means of vertical partition walls placed in the machine direction (not shown). Drying gases of different temperature, humidity, and/or pressure, as compared with one another, are passed into these blocks. Instead of, or in addition to, this construction, in different blocks, it is possible to employ sets of drying-gas jets having different velocities. By means of this arrangement, the drying of the paper web W can be regulated in the transverse direction, and the paper web can be given a transverse moisture profile of exactly the desired form, usually a uniform moisture profile. The realization of the regulation from block to block in the control of the transverse moisture profile is in itself known from various connections, so that it will not be described in more detail in this connection, nor illustrated in the figures.

In the following, a simulation example will be given in the form of a table concerning the evaporation capacities inside a drying module in accordance with the invention when through-drying is not employed on the large cylinder 15. In the following table, column (a) provides the evaporation capacities expressed as the units kg $H_2O$/h (kilograms of $H_2O$ per hour) in the initial end of the dryer section, and column (b) provides the corresponding evaporation capacities in the final end of the dryer section. Moreover, the drying capacities of the different parts of the module are, in the following table, also given as percentages out of the total evaporation capacity of the module 10.

| | (a) | | (b) | |
|---|---|---|---|---|
| | kg $H_2O$/h | % | kg $H_2O$/h | % |
| large cylinder (15) | 4429.7 | 67.7 | 4884.1 | 76.1 |
| 1st contact cyl. (21) | 544.7 | 8.3 | 513.7 | 8.0 |
| suction roll (22) | 1140.9 | 17.5 | 671.6 | 10.5 |
| 2nd contact cyl. (21) | 421.8 | 6.5 | 344.9 | 5.4 |
| | total | 100.0 | total | 100.0 |

As shown in table above, from about 65% to about 75% of the entire evaporation capacity of the module 10 takes place on the large cylinder 15, while the rest of the evaporation capacity is divided substantially evenly between the pair of contact cylinders 21 and the reversing suction roll 22. This is a significant advantage over the prior art dryer modules and dryer section.

The examples provided above are not meant to be exclusive. Many other variations of the present invention would be obvious to those skilled in the art, and are contemplated to be within the scope of the appended claims.

We claim:

1. Drying module for a dryer section of a paper machine, comprising a drying wire guided in a loop by guide rolls, a large-diameter cylinder having a diameter greater than about 2 m and arranged inside the loop of the drying wire, a web being carried on said drying wire over a contact sector a of said large-diameter cylinder, said sector a having a magnitude greater than about 180°, said large-diameter cylinder having an outer mantle provided with grooves and/or being penetrable by drying gas, a drying hood arranged over the contact sector a of said large-diameter cylinder, said drying hood having an interior and a nozzle field arranged in said interior in proximity to an outer face of the web, said nozzle field applying drying-gas jets at a high velocity against the web over a substantial area of the contact sector a, smooth-faced heated contact-drying cylinders arranged in proximity to, and at both sides of, said large-diameter cylinder, said contact-drying cylinders having diameters less than the diameter of said large-diameter cylinder and being arranged outside the drying-wire loop, the web being carried on said drying wire over contact sectors b of each of said contact-drying cylinders, said sectors b having a magnitude greater than about 180°, and at least one reversing suction roll arranged adjacent to a respective one of said contact-drying cylinders, said suction roll being arranged inside the drying-wire loop and having a diameter less than the diameter of said contact-drying cylinders, the web being carried on said drying wire over a contact sector c of said suction roll, said sector c having a magnitude greater than about 180°.

2. The drying module of claim 1, wherein the ratio of the diameter of said large-diameter cylinder to the diameter of said contact-drying cylinders is from about 1.0 to about 2.2, and the ratio of the diameter of said contact-drying cylinders to the diameter of said suction roll is from about 1.1 to about 2.2, the horizontal distance between adjacent ones of said contact-drying cylinders being about (0.3 to 2)×the diameter of said large-diameter cylinder, and the difference in height between adjacent ones of said contact-drying cylinders and said suction roll being about (0.1 to 1.1)×the diameter of said contact-drying cylinders, and the height ratio of the difference in height between said large-diameter cylinder and one of said contact-drying cylinders to the difference in height between said suction roll and said one of said contact-drying cylinders being from about 2 to about 10.

3. The drying module of claim 2, wherein the ratio of the diameter of said large-diameter cylinder to the diameter of said contact-drying cylinders is from about 1.5 to about 1.7, and the ratio of the diameter of said contact-drying cylinders to the diameter of said suction roll is from about 1.2 to about 1.6, and said height ratio of the difference in height between said large-diameter cylinder and said one of said contact-drying cylinders to the difference in height between said suction roll and said one of said contact-drying cylinders is from about 3 to about 6.

4. The drying module of claim 1, wherein at least one of said large diameter cylinder and said suction roll has a grooved outer mantle, perforations opening into said grooves and a suction duct arranged in an axle journal thereof, an interior of said at least one of said large-diameter cylinder and said suction roll communicating with a source of negative pressure through the suction duct.

5. The drying module of claim 2, further comprising suction means arranged in an interior of at least one of said large-diameter cylinder and said suction roll, said suction means applying negative pressure to the sector on which the web runs.

6. The drying module of claim 1, comprising first and second adjacent ones of said drying modules having a joint drying wire running through said first and second drying modules such that a horizontal distance between a large-diameter cylinder in said first drying module and a large-diameter cylinder in said second drying module is in a range from about (0.8–4)×the diameter of said large-diameter cylinder, a horizontal distance between a center of a large-diameter cylinder in said second drying module and a large-diameter cylinder in a third one of said drying modules adjacent to said second drying module is in a range from about (0.8–4)× the diameter of said large-diameter cylinder.

7. The drying module of claim 1, further comprising at least two of said drying modules arranged in a loop of said drying wire, the web being passed between said drying modules as a closed draw, and an additional reversing suction roll arranged between said at least two drying modules, the web being carried on an outside curve of said drying wire over a sector of said additional suction roll, said sector having a magnitude greater than about 160°.

8. A dryer section comprising a plurality of drying modules as claimed in claim 1, said drying modules being arranged adjacent to each other and numbering from about 3 to about 12, at least two adjacent ones of said drying modules having a common drying wire running therethrough, whereby said suction roll transfers the web in group gaps between said drying modules as a substantially closed draw.

9. A dryer section comprising a plurality of drying modules as claimed in claim 1, and at least one group of drying cylinders having a single-wire draw.

10. A dryer section comprising a plurality of drying modules as claimed in claim 1, and a plurality of successive groups of cylinders having a single-wire draw and comprising contact-drying cylinders arranged in an upper row and reversing suction rolls arranged in a lower row, and at least one of said drying module having a pair of said contact-drying cylinders arranged below said large-diameter cylinder such that the side of the web placed against said contact-drying cylinders is opposite from the side of the web placed against the outer face of said large-diameter cylinder.

11. A dryer section comprising a plurality of drying modules as claimed in claim 1 arranged adjacent to each other, wherein at least one of said drying modules is inverted in relation to adjacent ones of said drying modules.

12. A dryer section comprising a plurality of drying modules as claimed in claim 1, said drying modules arranged in an initial part of the dryer section and applying blowing-on drying via said large-diameter cylinder, and said drying modules arranged in a final part of the dryer section wherein the dry solids content of the web is at least about 75% applying through-drying via said large-diameter cylinder.

13. The drying module as claimed in claim 1, further comprising means for partitioning said drying hood into at least two sectors in a longitudinal direction of the paper machine.

14. The drying module as claimed in claim 1, further comprising means for partitioning said drying hood into a plurality of blocks in a transverse direction of the paper machine.

15. A dryer section comprising a plurality of drying modules as claimed in claim 1, wherein said suction roll, said large-diameter cylinder and said contact-drying cylinders in at least one of said drying modules arranged at an initial end of the dryer section have larger diameters than corresponding cylinders and rolls in subsequent ones of said drying modules.

16. The dryer section of claim 15, wherein the ratio of the diameters of said suction roll, said large-diameter cylinder and said contact-drying cylinders in said one of said drying modules to the corresponding cylinders and rolls in said subsequent drying modules is from about 1.2 to about 1.5.

17. A dryer section comprising a plurality of drying modules as claimed in claim 1, and at least one group of contact-drying cylinders arranged at a rear end of the dryer section, said at least one group of cylinders having a twin-wire draw in which the paper web has open free draws between said contact-drying cylinders.

18. The use of the drying module of claim 1 to modernize an existing dryer section and increase the running speed of the paper machine by utilizing the existing dryer section as a part of the modernized dryer section.

19. The use of the dryer section of claim 8 to modernize an existing dryer section and increase the running speed of the paper machine by utilizing the existing dryer section as a part of the modernized dryer section.

20. The drying module of claim 1, wherein said drying hood in association with said large-diameter cylinder provides a first pressure difference to the web such that the web is pressed against the drying wire over said sector a, said first pressure difference being from about 0.1 kPa to about 50 kPa, said at least one reversing suction roll providing a second pressure difference to the web such that the web is held on the drying wire, said second pressure difference being from about 0.5 kPa to about 5 kPa.

21. The drying module of claim 20, further comprising a first suction duct connected to axle journals of said large-diameter cylinder such that negative pressure is provided in an interior of said outer mantle of said large-diameter cylinder to thereby produce said first pressure difference, and a second suction duct connected to axle journals of said suction roll such that negative pressure is provided in an interior of a mantle of said suction roll to thereby produce said second pressure difference.

22. The drying module of claim 20, wherein said first pressure difference is from about 2 kPa to about 20 kPa, and said second pressure difference is from about 2 kPa to about 3 kPa.

23. The drying module of claim 1, wherein the velocity of said drying-gas jets of said nozzle field directed at the web in a blowing-on drying process is from about 50 m/s to about 150 m/s, and the velocity of the drying-gas jets directed at the web in a through-drying process is from about 20 m/s to about 60 m/s.

24. The drying module of claim 23, wherein the velocity of the drying-gas jets directed at the web in the blowing-on drying process is from about 80 m/s to about 130 m/s.

25. The drying module of claim 1, wherein a central axis of each of said contact-drying cylinders is arranged vertically below a central axis of said large-diameter cylinder and a central axis of said at least one reversing suction roll.

26. The drying module of claim 1, wherein a central axis of each of said contact-drying cylinders is arranged vertically above a central axis of said large-diameter cylinder and a central axis of said at least one reversing suction roll.

27. A dryer section for drying a web, comprising at least one drying module, said at least one drying module comprising a drying wire guided in a loop by guide rolls, a large-diameter cylinder having a diameter greater than about 2 m and arranged inside the loop of the drying wire, a web being carried on said drying wire over a contact sector a of said large-diameter cylinder, said sector a having a magnitude greater than about 180°, said large-diameter cylinder having an outer mantle provided with grooves and/or being penetrable by drying gas, a drying hood arranged over the contact sector a of said large-diameter cylinder, said drying hood having an interior and a nozzle field arranged in said interior in proximity to an outer face of the web, said nozzle field applying drying-gas jets at a high velocity against the web over a substantial area of the contact sector a, smooth-faced heated contact-drying cylinders arranged in proximity to, and at both sides of, said large-diameter cylinder, said contact-drying cylinders having diameters less than the diameter of said large-diameter cylinder and being arranged outside the drying-wire loop, the web being carried on said drying wire over contact sectors b of each of said contact-drying cylinders, said sectors b having a magnitude greater than about 180°, and at least one reversing suction roll arranged adjacent to a respective one of said contact-drying cylinders, said suction roll being arranged inside the drying-wire loop and having a diameter less than the diameter of said contact-drying cylinders, the web being carried on said drying wire over a contact sector c of said suction roll, said sector c having a magnitude greater than about 180°, and at least one group of drying cylinders having a single-wire draw, said single-wire draw group comprising contact-drying cylinders in a first row, reversing cylinders in a second row spaced from said first row, and a drying wire for pressing the web against said contact-drying cylinders.

28. The dryer section of claim 27, wherein said at least one drying module comprises a plurality of drying modules.

29. The dryer section of claim 28, further comprising a plurality of said groups of cylinders having a single-wire draw, at least one of said drying modules having a pair of said contact-drying cylinders therein arranged below said large-diameter cylinder therein such that the side of the web placed against said contact-drying cylinders is opposite from the side of the web placed against the outer face of said large-diameter cylinder.

30. A dryer section for drying a web, comprising at least one drying module, said at least one drying module comprising a drying wire guided in a loop by guide rolls, a large-diameter cylinder having a diameter greater than about 2 m and arranged inside the loop of the drying wire, a web being carried on said drying wire over a contact sector a of said large-diameter cylinder, said sector a having a magnitude greater than about 180°, said large-diameter cylinder having an outer mantle provided with grooves and/or being penetrable by drying gas, a drying hood arranged over the contact sector a of said large-diameter cylinder, said drying hood having an interior and a nozzle field arranged in said interior in proximity to an outer face of the web, said nozzle field applying drying-gas jets at a high velocity against the web over a substantial area of the contact sector a, smooth-faced heated contact-drying cylinders arranged in proximity to, and at both sides of, said large-diameter cylinder, said contact-drying cylinders having diameters less than the diameter of said large-diameter cylinder and being arranged outside the drying-wire loop, the web being carried on said drying wire over contact sectors b of each of said contact-drying cylinders, said sectors b having a magnitude greater than about 180°, and at least one reversing suction roll arranged adjacent to a respective one of said contact-drying cylinders, said suction roll being arranged inside the drying-wire loop and having a diameter less than the diameter of said contact-drying cylinders, the web being carried on said drying wire over a contact sector c of said suction roll, said sector c having a magnitude greater than about 180°, and at least one group of contact-drying cylinders having a twin-wire draw arranged at a rear end of the dryer section, said at least one group of cylinders having a twin-wire draw comprising contact-drying cylinders arranged in two rows, the web having open free draws between said two rows of contact-drying cylinders.

* * * * *